US005258210A

United States Patent [19]

Chalfin

[11] Patent Number: 5,258,210

[45] Date of Patent: Nov. 2, 1993

[54] LIGHTWEIGHT DECORATIVE PLASTIC ARTICLES

[75] Inventor: Bernard Chalfin, Tenafly, N.J.

[73] Assignee: Geisler Ganz Corporation, New York, N.Y.

[21] Appl. No.: 664,618

[22] Filed: Mar. 4, 1991

[51] Int. Cl.[5] ..... A44C 25/00; A47G 35/00

[52] U.S. Cl. ..... 428/28; 63/2; 63/DIG. 3; 428/31; 428/53; 428/99; 428/246; 428/483; 428/542.2; 428/904.4; 428/913.3

[58] Field of Search ..... 63/2, DIG. 3; 428/28, 428/53, 483, 542.2, 904.4, 913.3, 31, 99, 246; 8/471; 427/277

[56] References Cited

U.S. PATENT DOCUMENTS

| | | | |
|---|---|---|---|
| 951,926 | 6/1909 | White | 63/2 |
| 2,003,376 | 6/1933 | Lesmeister | 63/DIG. 3 |
| 2,778,208 | 1/1957 | Flint | 428/28 |
| 2,792,656 | 5/1957 | Glagovsky | 428/28 |

*Primary Examiner*—George F. Lesmes
*Assistant Examiner*—James D. Withers
*Attorney, Agent, or Firm*—Gottlieb, Rackman & Reisman

[57] ABSTRACT

A process for applying to fabric a plastic, metallic appearing, decorative article having on its surface decorative objects such as stones. The article comprises mylar layered upon a transparent polyvinyl chloride supporting layer. The article is designed to be formed either by a hot or a cold press and to be attached to fabric by simple processes such as sewing or employing hand or foot presses and known attaching fixtures for the decorative objects. Jewelry articles made from the plastic material are also part of the invention. In one embodiment a transparent adhesive is used between the plastic layers so that the decorative layer can be seen through the supporting layer.

10 Claims, 3 Drawing Sheets

FIG. 1A
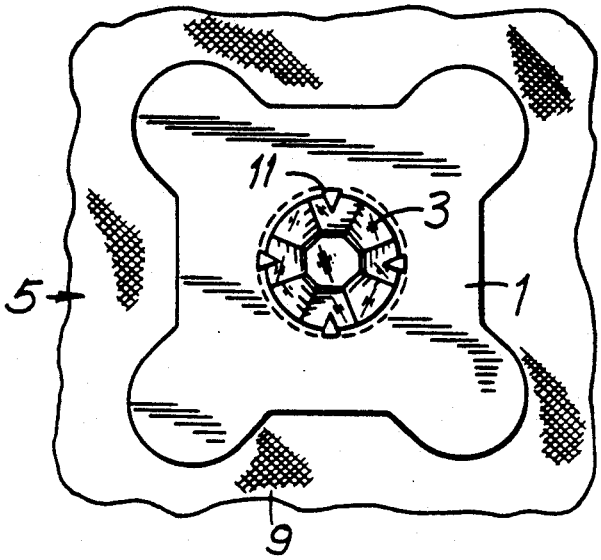
FIG. 1B
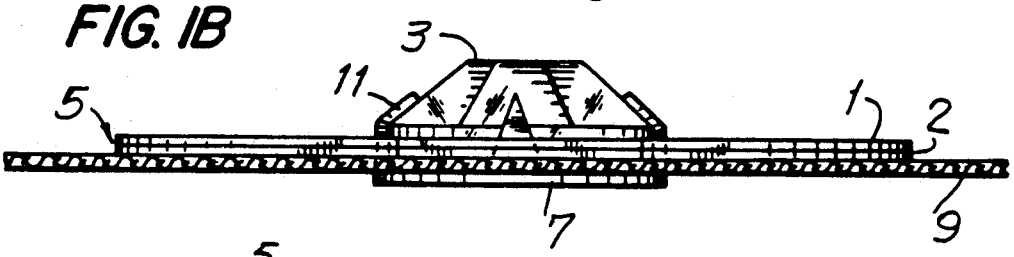
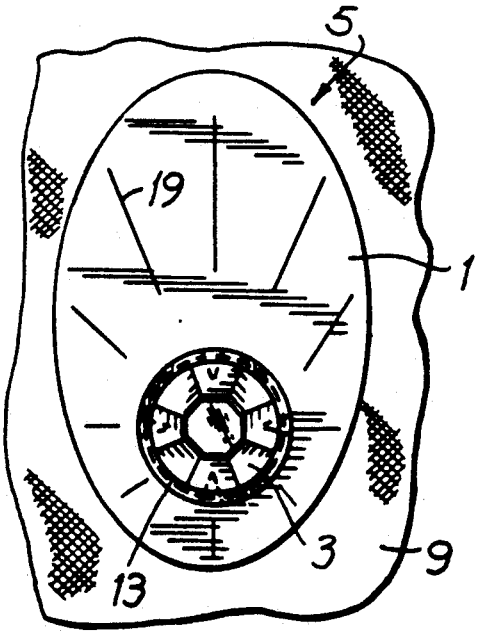
FIG. 2A
FIG. 2B
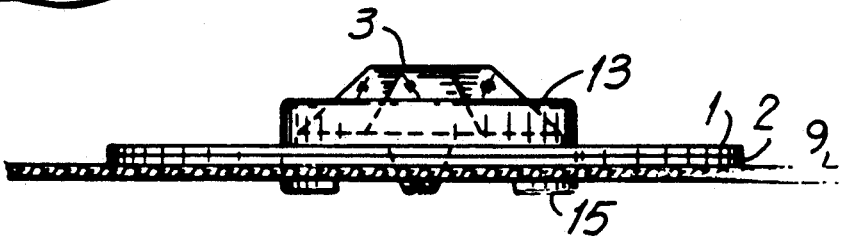

LIGHTWEIGHT DECORATIVE PLASTIC ARTICLES

FIELD OF THE INVENTION

This invention relates to methods for attaching metallic appearing decorative articles to fabric-like surfaces such as cloth or leather. The invention particularly relates to decorative articles manufactured from a plastic composite uniquely structured to enable the attaching processes of the present invention. In addition the invention relates to freestanding jewelry articles made from the plastic composite of the present invention.

BACKGROUND OF THE INVENTION

Articles of jewelry or other decorative hardware made of metal, having a generally planar configuration with relief figures on their surfaces and intended to be pinned or adhered to fabric, including imitation leather and leather are, of course well known. In general, however, the process for attaching such articles to fabric is cumbersome, expensive and leads to unattractive products. Often it involves separate attachment hardware and requires attempts to conceal unattractive aspects of the attachment hardware such as prongs, rivets or eyelets that are necessary to form settings that grasp the metal objects. The use of adhesives for attaching decorative metallic hardware to fabric is also known. However, the adhesives are generally unsatisfactory because they can fail to hold the decorative article when the fabric undergoes stretching, which is common with garments, or the adhesives lose their effectiveness during dry cleaning or washing This causes the loss of the decorative article and a generally unsightly appearance for the resulting garment. In particular the metal article cannot be adhered to fabrics by simple processes such as machine sewing because of the difficulty of penetrating the metal.

Other methods that are employed for the attachment of metal decorative hardware are hand sewing through pre-pierced holes, eyeletting, or pronging using heavy prongs soldered or welded to the hardware or prongs formed as a part of the metal decorative hardware. Each of these methods is both labor intensive and unattractive. Eyeletting is unattractive and most often requires a metal washer on the underside of the fabric. It is particularly ineffective in the case of loosely woven fabric. In the case of pronging, the prongs detract from the appearance of the finished article and most often the prongs on the underside of the fabric must be covered with a liner. Hitherto, despite the demand for attractively ornamented apparel these methods for attachment have nevertheless been continued because of the lack of a better process.

It is also attractive to attach small decorative items such as rhinestones or ornamental nailheads to the metallic decorative article. This has generally required additional processing steps unrelated to the overall problem of attachment of the decorative article to the underlying fabric.

BRIEF DESCRIPTION OF THE PRESENT INVENTION

The present invention is principally concerned with attaching novel decorative articles having a metallic appearing surface to fabric. To accomplish its purpose, the present invention utilizes a novel decorative article made of a plastic laminate that is lightweight and attractive and is capable of being easily penetrated by attachment hardware associated with additional decorative objects such as rhinestones, pronged ornaments, studs or ornamental nailheads. The invention allows a simplified process in which the entire decorative article may be assembled and fastened to a garment resulting in a product which is of lighter weight, improved attractiveness and is washable and dry cleanable without causing corrosion. The invention allows the use of rim or Tiffany settings, ornamental nailheads, studs (either singularly or with gang dies) or standard bar tack or button attaching sewing machines to accomplish the attachment of the article to fabric. Multi-pronged nailheads and/or rhinestone settings may be used to attach the decorative objects to the article or the article to fabric by a process that employs existing machinery such as air and/or electrical presses, footpresses, or handpresses in conjunction with standard attaching dies.

The decorative articles of the present invention are made of thin sheets of a plastic laminate which has the surface appearance of a precious metal such as gold, bronze or silver. The material comprises a polyvinyl chloride support layer, preferably transparent, to which is adhered one or more thin mylar layers having a gold, bronze or silver surface color. Decorative items such as rhinestones or decorative nailheads are applied to the article by a process that may simultaneously attach the article to a fabric material.

The plastic laminate of the present invention is suited to shaping in a heat forming or cold stamping process and therefore lends itself to economical manufacturing processes.

The invention further relates to completely free standing objects (i.e. not attached to fabric) made from a polyvinyl chloride layer laminated on one or both sides by thin mylar layers. In a further embodiment, the invention relates to polyvinyl chloride that is transparent, laminated on only one side with a gold, silver, bronze colored or other colored double faced mylar layer visible from both sides of the laminated structure.

In short, the present invention relates to jewelry products, apparel and fashion accessory decorations fashioned from a plastic material which has the appearance of rich looking metals, such as gold, silver or bronze and is particularly useful for the apparel and apparel accessories market. The articles of the present invention are easily attached to cloth or other soft goods, for example, by a sewing machine making its own hole in the article during the attachment process. It enables the attachment to be made with existing machinery, foot presses, hand presses and attaching dies. The articles are also washable and dry cleanable.

It is an object of the present invention to provide a process for attaching decorative articles to fabric comprising the steps of creating an assembly by placing in contact a fabric material, a metallic appearing plastic laminate comprising a rigid polyvinyl chloride support layer to which is adhered one or more layers of colored mylar, one or more decorative objects and one or more attachment members for the decorative objects, fastening together in a single step the said assembly by applying pressure that causes the attachment members to penetrate the fabric material and the plastic laminate and to fix the decorative object to the plastic laminate simultaneously with fixing the plastic laminate to the fabric.

It is a further object of the present invention to provide a process for attaching decorative articles to fabric wherein said decorative object is a stone and said attachment member is a Tiffany setting having a multiplicity of prongs extending therefrom and wherein said fastening step comprises applying pressure to cause the prongs of the Tiffany setting to penetrate in sequence said fabric material, said plastic laminate and to grass said stone.

It is a further object of the present invention to provide such a process for attaching decorative articles to fabric wherein said stone is held in a vacuum fixture separate from said other components of the assembly and brought in contact with the prongs of the Tiffany setting during the step of applying pressure to the assembly.

It is a still further object of the present invention to provide a process for attaching decorative articles to fabric wherein said decorative object is a stone and said attachment member is a rim setting placed in contact with said stone having a multiplicity of prongs extending therefrom and wherein said fastening step comprises applying pressure to cause the rim setting to retain the stone in contact with the plastic laminate while the prongs of the rim setting penetrate in sequence said plastic laminate and said fabric material.

It is a further object of the present invention to provide a process for attaching decorative articles to fabric wherein said attachment member is a nailhead having one or more prongs adapted to penetrate said plastic laminate and said fabric and the decorative object is the upper surface of the nailhead.

It is a still further object of the present invention to provide a process for attaching decorative articles to fabric wherein said nailhead is held in a gang die adapted to retain a plurality of such nailheads in a predetermined pattern.

It is another object of the present invention to provide a process for attaching one or more decorative objects to a metallic appearing plastic laminate comprising a rigid polyvinyl chloride support layer to which is adhered one or more layers of colored mylar, said process comprising the steps of creating an assembly by placing in contact said plastic laminate, one or more decorative objects and one or more attachment members for the decorative objects, and fastening the assembly together in a single step by applying pressure that causes the attachment members to penetrate the plastic laminate and to fix the decorative object to the plastic laminate.

It is a still further object of the present invention to provide a process for attaching one or more decorative objects to a metallic appearing plastic laminate wherein said decorative object is a rhinestone and said attachment member is a Tiffany setting having a multiplicity of prongs extending therefrom and wherein said fastening step comprises applying pressure to cause the prongs of the Tiffany setting to simultaneously penetrate said plastic laminate and to grasp said stone.

It is a yet further object of the present invention to provide a process for attaching one or more decorative objects to a metallic appearing plastic laminate wherein said stone is held in a vacuum fixture separate from said other components of the assembly and brought in contact with the prongs of the Tiffany setting during the step of applying pressure to the assembly.

It is a further object of the present invention to provide a process for attaching one or more decorative objects to a metallic appearing plastic laminate wherein said decorative object is a stone and said attachment fixture is a rim setting placed in contact with said stone having a multiplicity of prongs extending therefrom and wherein said fastening step comprises applying pressure to cause the rim setting to retain the stone in contact with the plastic laminate while the prongs of the rim setting simultaneously penetrate said plastic laminate.

It is a further object of the present invention to provide a process for attaching one or more decorative objects to a metallic appearing plastic laminate wherein said decorative object is an attachment member such as an ornamental nailhead having one or more prongs adapted to penetrate said plastic laminate and said fabric.

It is a still further object of the present invention to provide a process for attaching one or more decorative objects to a metallic appearing plastic laminate wherein said nailhead is held in a gang die adapted to retain a plurality of such nailheads in a predetermined pattern.

In another aspect of the invention it is an object of the present invention to provide a decorative article attached to fabric comprising in contact a fabric material, a metallic appearing plastic laminate comprising a rigid polyvinyl chloride support layer to which is adhered one or more layers of colored mylar, one or more decorative objects and one or more attachment member for the decorative objects, wherein said article is held together by having the attachment members penetrate the fabric material and the plastic laminate and to fix the decorative objects to the plastic laminate and fix the plastic laminate to the fabric.

It is a further object of the present invention to provide a decorative article attached to fabric wherein said decorative object is a stone and said attachment member is a Tiffany setting having a multiplicity of prongs extending therefrom and wherein the prongs of the Tiffany setting penetrate in sequence said fabric material, said plastic laminate and grasp said stone.

It is an object of the present invention to provide a decorative article attached to fabric wherein said decorative object is a stone and said attachment member is a rim setting in contact with said stone having a multiplicity of prongs extending therefrom and wherein said rim setting retains the stone in contact with the plastic laminate while the prongs of the rim setting penetrate in sequence said plastic laminate and said fabric material.

It is an object of the present invention to provide a decorative article attached to fabric wherein said attachment member is a nailhead having one or more prongs simultaneously penetrating s id plastic laminate and said fabric.

It is a still further object of the present invention to provide a decorative article attached to fabric wherein said nailhead is one of a plurality of such nailheads in a pattern.

In yet another aspect of the present invention it is an object of the present invention to provide a decorative article comprising in contact a metallic appearing plastic laminate comprising a rigid polyvinyl chloride support layer to which is adhered one or more layers of colored mylar, one or more decorative objects and one or more attachment members for the decorative objects, wherein said article is held together by having the attachment members penetrate the plastic laminate and fix the decorative objects to the plastic laminate.

It is yet another object of the present invention to provide a decorative article wherein said decorative object is a stone and said attachment member is a Tiffany setting having a multiplicity of prongs extending therefrom and wherein the prongs of the Tiffany setting penetrate said plastic laminate and simultaneously grasp said stone.

It is another object of the present invention to provide a decorative article wherein said decorative object is a stone and said attachment member is a rim setting in contact with said stone and having a multiplicity of prongs extending therefrom, said rim setting retaining the stone in contact with the plastic laminate while the prongs of the rim setting simultaneously penetrate said plastic laminate.

It is another object of the present invention to provide such a decorative article wherein said attachment member is a nailhead having one or more prongs simultaneously penetrating said plastic laminate and said fabric.

It is yet another object of the present invention to provide a decorative article wherein said nailhead is one of a plurality of such nailheads in a predetermined pattern.

In another aspect of the invention it is an object of the present invention to provide such a jewelry article formed from a self-supporting rigid vinyl structure to which is adhered one or more ornamentally colored decorative plastic layers.

It is another object of the present invention to provide such an article wherein said decorative plastic layer comprises mylar.

It is another object of the present invention to provide such an article wherein said rigid support comprises a layer of polyvinyl chloride plastic.

It is another object of the present invention to provide such an article wherein said ornamentally dual sided colored decorative layer is present substantially on only one side of said support and a transparent adhesive layer is present between said decorative layer and said support structure and adheres said decorative layer to said support structure resulting in the support structure appearing gold, silver or other color on both sides.

It is a still further object of the present invention to provide such a jewelry article formed from a self-supporting rigid vinyl support structure to which is adhered one or more ornamentally colored decorative plastic layers.

BRIEF DESCRIPTION OF THE DRAWINGS

FIG. 1A is a top view of a decorative article of the present invention attached to fabric employing a Tiffany setting.

FIG. 1B is a side view of the article of FIG. 1A.

FIG. 2A is a top view of a decorative article of the present invention attached to fabric employing a rim setting.

FIG. 2B is a side view of the article of FIG. 2A.

DETAILED DESCRIPTION OF A PREFERRED EMBODIMENT

Figure 3:
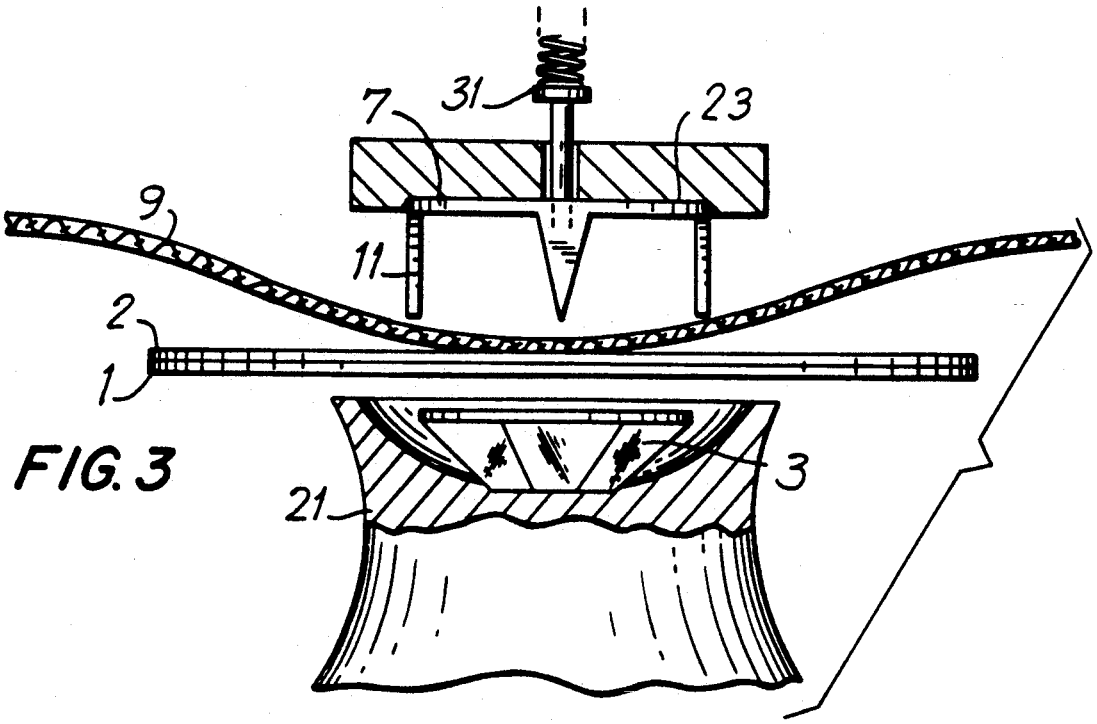
FIG. 3 is a side view of one embodiment of the process of manufacturing the article of FIG. 1A.

As shown in FIGS. 1A and 1B, one embodiment of the present invention comprises a decorative article generally denoted as 5 which comprises a mylar plastic laminate 2 adhered to a 0.020 inch rigid polyvinyl chloride (PVC) base 2. The thickness of the layers is exaggerated in the figure. The PVC provides a clear rigid vinyl supporting structure for the decorative article. A decorative object such as a rhinestone 3 or other attractive object is placed on the upper surface of the topmost layer and also embellishes part of the decorative article 5. The decorative article is in contact with a fabric (including leather) surface 9 which it decorates. The decorative object 3 is attached to the remainder of the decorative article and to the fabric by a retaining setting 7, which is in this case a Tiffany setting that has prongs 11 passing upwards through the fabric 7, the PVC and Mylar layers and bending inward to retain the decorative object 3. As shown the decorative article has only a single decorative object on its surface, but the invention also contemplates a plurality of such objects on the surface of the decorative article each held by a separate retaining setting.

As an alternative embodiment, FIG. 2A and 2B show a different decorative article in which the decorative object is attached by a rim setting. In this embodiment the rim setting 13 retains the decorative object 3 on the surface of the mylar as before, but the prongs 15 of the setting pass downward through the mylar, the PVC and the fabric material to be bent under the fabric and to hold the entire construction together.

Figure 7A:
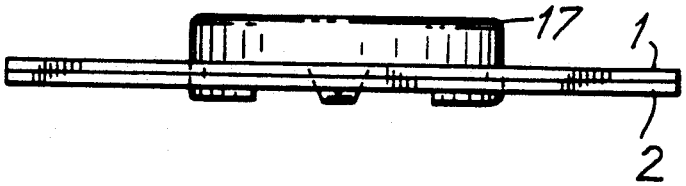
FIG. 7A is a side view of a decorative article of the present invention employing a stud.
Figure 7B:
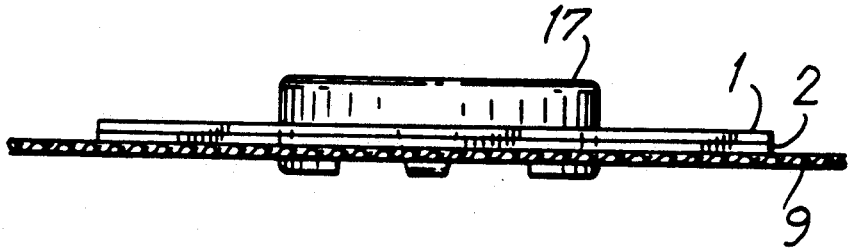
FIG. 7B is a side view of a decorative article of the present invention attached to fabric employing a stud.

As a further alternative, as shown in FIG. 7B, studs 17 or other decorative nailheads, may be used in the place of stones with their attaching fixtures, and placed in the same orientation as the rim type member.

As shown in FIG. 2A by the lines 19, the upper plastic surface of the decorative article may have a textured and shaped appearance. The textured appearance can be accomplished by rolling the laminated material in the sheet or coil form prior to further processing. The shaping ca be accomplished by stamping operations on the plastic multilayer composition prior to assembly, employing either hot or cold presses. The use of cold pressing is particularly advantageous since it is a simpler and more economical manufacturing process known in the art of pressing metals.

The decorative articles shown in FIGS. 1A through 2B have several advantages over the metallic articles. In particular they are far less costly per surface area, not subject to corrosion and are lighter in weight. A principal advantage is the simplicity of the construction of the articles.

As shown in FIG. 3, the components of the decorative article and the fabric may be assembled in a press. The upper jaw of the press holds a die 19 having a recess 23 and/or a spring loaded pin onto which the Tiffany setting 7 is placed. The height of the setting is exaggerated in the figure. The spring loaded pin 31 friction holds and helps center the setting. The invention also contemplates the use of gang dies having a plurality of recesses and/or spring loaded pins in an attractive pattern, each recess and/or pin receiving a separate setting. The height of the setting is exaggerated in the figure. The fabric material and the plastic laminate are placed under the setting. The lower jaw 21 of the press retains the decorative object. The press causes the prongs 11 of the setting to penetrate and retain the fabric 9 and the plastic layers 1 and 2 and to wrap around the decorative object 3 in a single pressing operation. Thus a single simple pressing operation uses the setting member to affix the decorative object to the remainder of the decorative article and at the same time to affix the entire structure to the fabric.

Figure 4:
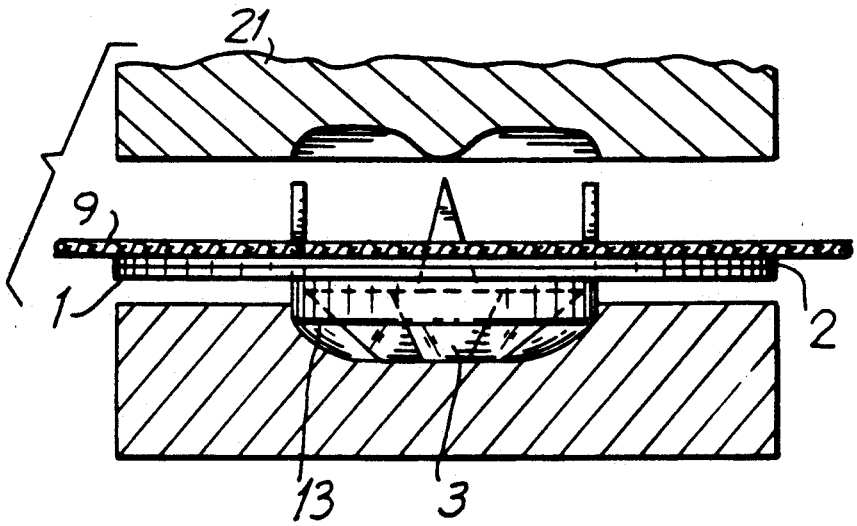
FIG. 4 is a side view of one embodiment of the process of manufacturing the article of FIG. 2A.

FIG. 4 shows the method of attachment employing a ring or rim setting. In this case the rim followed by the decorative object are placed face down in turn upon the lower jaw of the press. The plastic composition 1 and 2 and the fabric 9 are placed in position above these. The lower jaw of the press has a recess that supports the prongs and allows pressure to be applied to the ring without unduly compressing the decorative object 3. As a result the prongs 13 of the ring setting are driven upwards through the plastic material and fabric to be deformed by the recess in the upper die, thereby clinching the objects together and holding the decorative object, in this case a rhinestone, in position on the plastic while being affixed to the fabric.

In place of the rim setting, a decorative object such as a stud or decorative nailhead may be employed without the presence of the additional decorative object 3. Again, gang dies may be used to place a series of such nail heads in a decorative pattern in a single operation. This is an operation that could not easily be accomplished on metal decorative objects due to the difficulty of penetrating the metal surface and/or aligning prepunched holes of the decorative metal object with the prongs of the nailhead.

Figure 8:
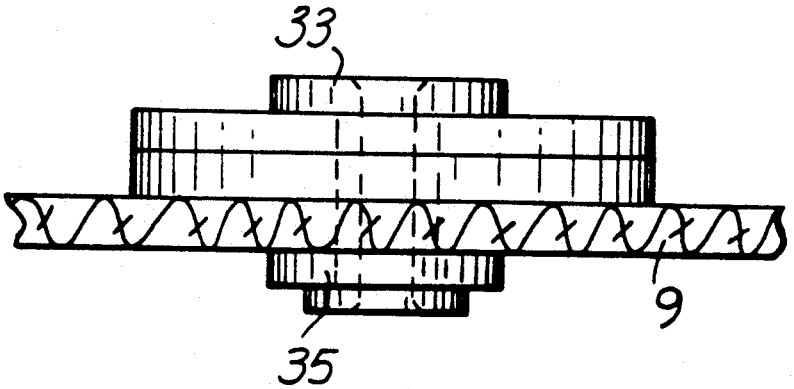
FIG. 8 is a side view of a decorative article of the present invention attached to fabric employing a eyelet.

As shown in FIG. 8, an eyelet 33 maybe placed in a hole through the fabric and plastic layers and passed through a washer 35. The assembly may then be placed in a press to deform the lower surface of the eyelet against the washer.

Figure 5:
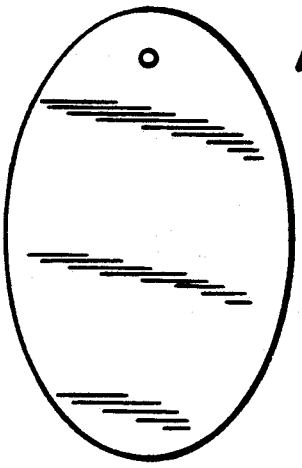
FIG. 5 is a top view of an embodiment of a decorative jewelry article of the present invention.
Figure 6:
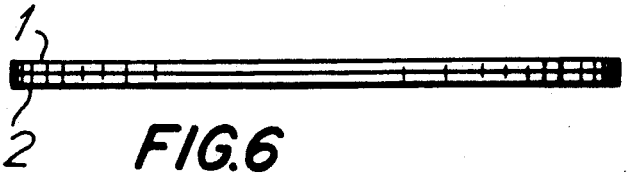
FIG. 6 is a side view of the decorative jewelry article of FIG. 5.

The invention also contemplates making the decorative articles for use independent of the attachment to fabric. FIG. 7A is an example employing a nailhead as the decorative object. As shown in FIG. 5 and its cross-sectional view FIG. 6, the freestanding object has sufficient rigidity to serve, for example, as an earring pendant. For this purpose a hole may easily be pierced in the upper portion of the article to allow the attachment of a kidney wire or other earring fixture (not shown). The plastic composite of the present invention is particularly suited for earrings in view of its light weight. This enables large earrings to be worn without the normal discomfort experienced by the wearer of metal pendant earrings.

In general the PVC layer has a thickness of between 0.006" and 0.060". The mylar layers have a thickness of between 0.0005 and 0.0010". The freestanding jewelry article contemplated by this invention may have either one or two colored mylar layers on the PVC. In the case of a single mylar layer, its color is visible from both sides of the PVC layer because it is viewed through the transparent PVC. For this purpose a transparent adhesive is used to bond the plastic layers together.

Although the invention has been depicted with the mylar as the exposed visible layer when the article is placed against fabric, it is also contemplated that the layers be reversed so that the mylar is viewed through the PVC. This gives a depth dimension and softer look to the object.

While there have been shown and described and pointed out the fundamental novel features of the invention as applied to preferred embodiments thereof, it will be understood that various omissions and substitutions and changes in the illustrated form and details of the device and methods of manufacture may be made by those skilled in the art without departing from the spirit of the invention. It is the intention, therefore, to be limited only as indicated by the scope of the claims appended hereto.

I claim:

1. A decorative article attached to fabric comprising in contact a fabric material, a metallic appearing plastic laminate comprising a rigid transparent polyvinyl chloride support layer to which is adhered one or more layers of colored metallized polyester, one or more decorative stone-like objects and one or more pronged attachment members for the decorative objects, wherein said article is held together by having the attachment member penetrate the fabric material and the plastic laminate thereby fixing the decorative objects to the plastic laminate and fixing the plastic laminate to the fabric.

2. The decorative article attached to fabric of claim 1 wherein said decorative object is a stone and said attachment member is a Tiffany setting having a multiplicity of prongs extending therefrom and wherein the prong of the Tiffany setting penetrate in sequence said fabric material, said plastic laminate and grasp said stone.

3. The decorative article attached to fabric of claim 1 wherein said decorative object is a stone and said attachment member is a rim setting in contact with said stone having a multiplicity of prongs extending therefrom and wherein said rim setting retains the stone in contact with the plastic laminate while the prongs of the rim setting penetrate in sequence said plastic laminate and said fabric material.

4. The decorative article attached to fabric of claim 1 wherein said decorative object is the upper surface of a nailhead and said attachment member is the nailhead having one or more prongs penetrating said plastic laminate and said fabric.

5. The decorative article or articles attached to fabric of claim 4 wherein said nailhead is one of a plurality of such nailheads in a pattern.

6. A decorative article comprising in contact a metallic appearing plastic laminate comprising a rigid transparent polyvinyl chloride support layer to which is adhered one or more layers of colored metallized polyester, one or more decorative stone-like objects and one or more pronged attachment members for the decorative objects, wherein said article is held together by having the attachment member penetrate the plastic laminate and fixing the decorative objects to the plastic laminate.

7. The decorative article of claim 6 wherein said decorative object is a stone and said attachment member is a Tiffany setting having a multiplicity of prongs extending therefrom and wherein the prongs of the Tiffany setting penetrate said plastic laminate and grasp said stone.

8. The decorative article of claim 6 wherein said decorative object is a stone and said attachment member is a rim setting in contact with said stone and having a multiplicity of prongs extending therefrom, said rim setting retaining the stone in contact with the plastic laminate while the prongs of the rim setting penetrate said plastic laminate.

9. The decorative article of claim 6 wherein said attachment member is a nailhead having one or more prongs penetrating said plastic laminate.

10. The decorative article or articles of claim 9 wherein said nailhead is one of a plurality of such nailheads in a predetermined pattern.

* * * * *